United States Patent [19]

Maschke

[11] 4,350,927

[45] Sep. 21, 1982

[54] MEANS FOR THE FOCUSING AND ACCELERATION OF PARALLEL BEAMS OF CHARGED PARTICLES

[75] Inventor: Alfred W. Maschke, East Moriches, N.Y.

[73] Assignee: The United States of America as represented by the United States Department of Energy, Washington, D.C.

[21] Appl. No.: 189,990

[22] Filed: Sep. 23, 1980

Related U.S. Application Data

[63] Continuation-in-part of Ser. No. 152,461, May 23, 1980.

[51] Int. Cl.[3] ..... H01J 25/10

[52] U.S. Cl. ..... 315/5.41; 250/396 R; 315/5.42; 315/5.35; 330/4.7; 328/233

[58] Field of Search ..... 315/5.41, 5.42, 5.35, 315/5, 3; 330/4.6, 4.7; 328/233; 313/261.1, 414; 250/396 R

[56] References Cited

U.S. PATENT DOCUMENTS

| | | | |
|---|---|---|---|
| 2,940,001 | 6/1960 | Post | 315/5.42 |
| 3,147,445 | 9/1964 | Wuerker et al. | 330/4.7 |
| 3,252,104 | 5/1966 | Gordon | 330/4.7 |
| 3,304,461 | 2/1967 | Prine | 330/4.7 X |
| 3,376,449 | 4/1968 | Harrison | 313/361.1 X |
| 3,482,136 | 12/1969 | Herrera | 313/361.1 |
| 3,932,749 | 1/1976 | Taylor | 328/233 |
| 4,211,954 | 7/1980 | Swenson | 315/5.42 |

*Primary Examiner*—Saxfield Chatmon, Jr.

[57] ABSTRACT

Apparatus for focusing beams of charged particles comprising planar arrays of electrostatic quadrupoles. The array may be assembled from a single component which comprises a support plate containing uniform rows of poles. Each pole is separated by a hole through the plate designed to pass a beam. Two such plates may be positioned with their poles intermeshed to form a plurality of quadrupoles.

10 Claims, 9 Drawing Figures

MEANS FOR THE FOCUSING AND ACCELERATION OF PARALLEL BEAMS OF CHARGED PARTICLES

BACKGROUND OF THE INVENTION

The U.S. Government has rights in this invention pursuant to Contract Number DE-AC02-76CH00016, between the U.S. Department of Energy and Associated Universities, Inc.

This is a continuation-in-part of my prior application Ser. No. 152,461, filed on May 23, 1980, entitled, "Means and Method for the Focusing and Acceleration of Parallel Beams of Charged Particles".

This invention relates to an apparatus and method for focusing beams of charged particles and particularly to an apparatus for focusing a plurality of parallel beams of charged particles. It relates still more particularly to a novel linear accelerator adapted to accelerate a plurality of parallel beams of charged particles.

Linear accelerators, or Linacs, are devices which use radio frequency energy to accelerate charged particles such as electrons, protons and ions. FIG. 1 shows a schematic illustration of the basic operating principles of one type of Linac.

The charged particles from ion source 2 enter at the left of drift tube 10 at a given velocity, the length of drift tube 10 being chosen so that as particles emerge the phase of the radio frequency (RF) voltage provided by source 20 is such that the particles are accelerated towards drift tube 12. After the particles are accelerated across the gap between drift tubes 10 and 12, they enter drift tube 12 where they are again shielded from the effects of the RF voltage. Drift tube 12 is similarly designed so that as the particles emerge the phase of the radio frequency voltage is again such as to accelerate the particles towards drift tube 13. This process is repeated again between drift tubes 13 and 14 and for as many additional sections as are necessary to achieve the desired particle energy. It should be noted that the lengths of the drift tubes increase as necessary to compensate for the increasing velocity of the particles so that the time required for the particles to travel, distance d from the center of one gap to the center of the next is always approximately ½ the period of the RF voltage. In the prior art, means (not shown) are provided for generating focusing forces acting on the particle beam so as to counteract its tendency to diverge. Such means might be either electrostatic or electromagnetic in nature, but typically were electromagnetic. Also, in the prior art means 4 were provided to initially accelerate the charged particles so that they would enter the Linac at the design injection velocity. Typically, an accelerator of the type known as a Cockcroft-Walton was used as the preaccelerator. A description of the prior art preaccelerators is not necessary to an understanding of the present invention, except to note that such preaccelerators were expensive and complicated. Buncher means 6 to bunch the particles so that they would enter the Linac at the proper phase of the Rf voltage were also known in the prior art.

Prior art Linacs were also provided with a vacuum system 6, for maintaining the vacuum necessary for the acceleration of the beam.

It is obvious from inspection of FIG. 1 that a Linac is inherently a constant current device (i.e., the output current at time t is essentially equal to the input current time t-T, where T is the transmit time of the Linac).

Therefore, to increase the output current it is necessary to increase the input current. However, for a given focusing force strength, the current density is limited by the space charge effect (i.e., the mutual repulsive forces between the charge particles). It may be shown that this space charge effect decreases with increasing energy of the particles. It is for this reason that a preaccelerator is used in the prior art to give the initially injected particles substantial energy so as to reduce space charge effect and increase the achievable input current to the Linac without the need to increase the physical size of the Linac.

There is, however, another important parameter for Linac beams, "brightness" or six dimensional phase space density. (The concept of "brightness" is well understood by those skilled in the art linear accelerator design and may be considered for our purposes to be a parameter which increases with increasing current density and decreases with an increasing tendency for the beam to diverge after it leaves the Linac). Unfortunately, it may also be shown that the maximum possible "brightness" decreases with increasing injection energy. This unfortunate tradeoff has acted as a constraint on the production of high current, high brightness Linacs which would be extremely desirable for applications such as heavy ion fusion. Further, the limitations of preaccelerator technology have acted as a limitation on the achievable current density for Linacs without regard to brightness.

Referring again to FIG. 1 and the above discussion, it will be evident that the total length of a Linac is inversely proportional to the operating frequency of the RF potential. Obviously, other things being equal, it would be desirable to operate a Linac at a high frequency. However, another effect limits the use of high frequency in a Linac. Since particles require a finite time to cross the accelerating gaps it is necessary as the frequency is increased to reduce the gap distance since otherwise variations in the potential seen by particles entering the gap at slightly different times will cause excessive longitudinal dispersions in bunches of particles. However, the extent to which the gap size may be reduced is limited though by a relationship (which is well known to those skilled in the accelerator art) which shows that the diameter of the aperture of the drift tubes must be less than or approximately equal to the gap length. Since current density is limited by space charge, with a reduction in gap length there is a necessary reduction in aperture size and thus in the maximum current which may be accelerated. Thus, high current, high power accelerators tend to be extraordinarily large devices, in extreme cases reaching lengths of more than a mile.

It should be noted that other types of Linacs exist, differing in various details from the type illustrated. These details, however, do not affect the focusing problems discussed and the focusing apparatus of this invention could readily be adapted to such other types of Linac.

It is also known that space charge effects occur in other types of apparatus where beams of charged particles are transported, whether with or without acceleration. It is within the contemplation of this invention that the focusing apparatus of the invention may be used in such other types of apparatus, which include but are not limited to, DC accelerators, klystron tubes, beam transport lines and mass spectrometer or separation apparatus. Each of these types of apparatus, as well as others not discussed, comprise means for the transport of focused beams of charged particles and may benefit from the application of the principles of this invention and incorporation of the focusing apparatus of the invention.

Thus, it is an object of the present invention to provide a novel type of focusing apparatus which will provide beams approaching maximum brightness and which will focus beams having essentially any desired total current without increasing the strength of the focusing forces.

It is another object of the present invention to provide a single component which may be used to produce a plurality of electrostatic focusing elements.

It is another object of to provide arrays of focusing elements which require DC potential to be supplied only to the array support plate.

BRIEF SUMMARY OF THE INVENTION

The above and other disadvantages of the prior art are overcome in the present invention by means of a novel focusing apparatus adapted to focus a plurality of small beams or "beamlets". This apparatus comprises a planar array of electrostatic quadrupoles suitable for applying strong focusing forces to a plurality of parallel "beamlets". By electrostatic quadrupole herein is meant an assembly of four electrodes, their centers being on the circumference of a circle and separated by 90°, each of the electrodes being connected to a DC potential, the polarity of that potential being the same for opposing pairs of electrodes and opposite for adjacent pairs of electrodes. The concept of strong focusing is well known to those skilled in the accelerator art and for our purposes may be considered as a means of focusing wherein the major components of the forces developed by the focusing device are restoring forces in one direction orthogonal to the beams and anti-restoring forces in the other orthogonal direction so that a strong net focusing effect may be achieved by alternating focusing devices of opposite polarities.

Thus, the present invention provides a method for focusing parallel beams of charged particles by providing regions of fields suitable for applying strong focusing forces to parallel beams of charged particles; the direction of the fields being reversed in alternate regions.

The above described arrays are then incorporated into drift tube assemblies by mounting the quadrupole array within means for shielding said array so that particles within said means are unaffected by the RF accelerating field. The shielding means may comprise two conductive plates each provided with a plurality of holes aligned with the apertures of the quadrupoles. The shielding means extend sufficiently beyond the array so that the volume between plates containing the array is shielded from external RF fields and the distance between the plates is appropriately chosen so that the assembly may function as a drift tube for the plurality of parallel beamlets contemplated by the present invention.

A linear accelerator may then be made which comprises a plurality of such drift tubes mounted and aligned within a vacuum vessel. The lengths of, and spacing between, of the drift tubes being appropriately chosen, by means well known to those skilled in the linear accelerator art; means for generating an RF accelerating field between drift tubes being provided; and the quadrupoles of each drift tube assembly being connected to a source of DC focusing voltage, the DC polarities of alternate quadrupole arrays being reversed.

It is a particular advantage of the subject invention that electrostatic quadrupoles are inexpensive both to build and to operate when compared to magnetic quadrupoles. Additionally, in an embodiment described more fully below, the number of electrodes in the array of the invention is essentially equal to only twice the number of quadrupoles for large arrays. Thus, large arrays, which imply large total currents, may be constructed and operated economically.

One configuration of the quadrupoles is particularly economical to construct. It contains only one component which comprises a support plate and uniformly spaced rows of poles which are mounted on one side of the plate. The rows are parallel to one another and each pole in the rows is separated from the next by a hole through the plate designed to pass a beam. By placing two of these components with their poles facing each other and with the rows of poles oriented orthogonally, the poles may be intermeshed to form a plurality of quadrupoles. DC potential need be supplied only to the plates which in turn conduct the DC potential to the poles. Arrays of quadrupoles formed in this way may be cascaded by placing the plates of each array back to back. In such cascaded configurations, the DC potential is automatically set for alternate reversal of polarity of the horizontal and vertical poles in successive quadrupoles.

It is a further advantage that in use, charged particles may be injected into the Linac of the present invention with no more energy than that which is needed to extract particles from the source. Still further, the RF gaps between drift tubes may be made as small as desired, so long as the potential gradient between drift tubes is not great enough to cause breakdown, and the Linac operated at higher frequencies than have heretofore been practicable. While both increasing the brightness and/or the frequency will tend to reduce the current in a particular beamlet, the total current in the Linac may be raised to any desired level merely by increasing the number of quadrupole array and thus increasing the number of beamlets.

It should be noted that the Linac of the present invention is inherently suited to operate with modern efficient sources of charged particles where the particles are extracted from the source through a plurality of apertures since each aperture of the source may be associated with a particular beamlet of the subject Linac.

DETAILED DESCRIPTION OF THE INVENTION

Figure 1:
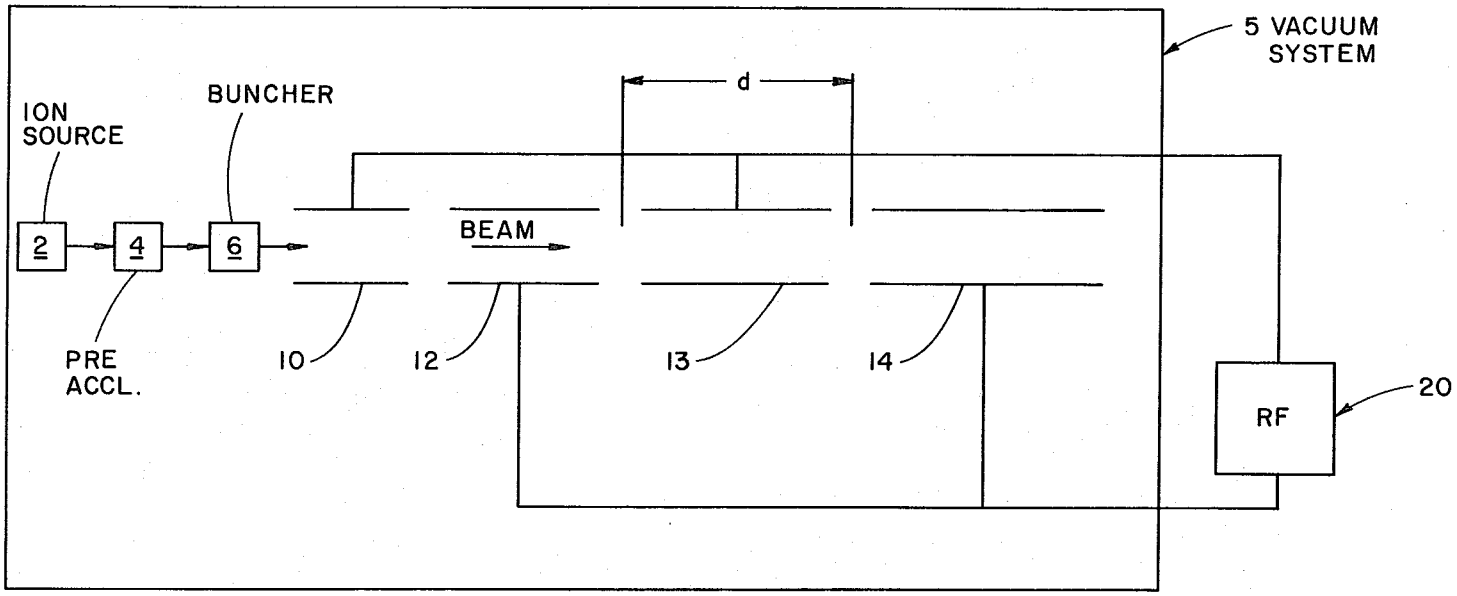
PRIOR ART Fig. 1
FIG. 1 is a schematic representation illustrating the basic operating principles of one type of Linac.
Figure 2:
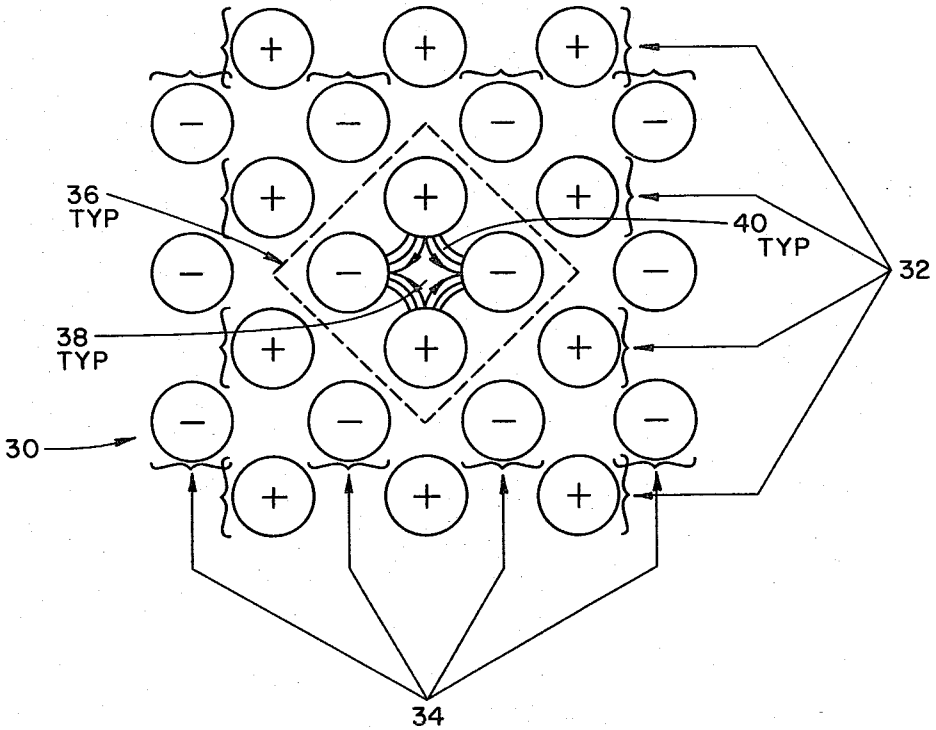
FIG. 2 is a schematic representation of a planar array of electrostatic quadrupoles showing the relative polarities of the electrodes and the electrostatic lines of force in a particular quadrupole aperture.

Referring to FIG. 2 there is shown a schematic representation of a planar array 30 of electrostatic quadrupoles 36. Array 30 comprises a first plurality of electrodes 32 having a DC potential of one polarity, shown as positive, and a second plurality of electrodes 34 having an opposite DC polarity. It is preferred that electrodes of pluralities 32 and 34 in general function as electrodes in more than one of quadrupoles 36. In a compact configuration a square array of $N^2$ quadrupoles may be formed from $2(N^2+N)$ electrodes, $(N^2+N)$ electrodes 32 carrying a DC potential of one polarity and $(N^2+N)$ electrodes 34 carrying the opposite polarity.

The four electrodes which comprise each of quadrupoles 36 define apertures 38 which are preferably approximately equal in diameter to the diameters of the electrodes. Within apertures 38 lines of force 40 illustrate the direction of the net force which would be felt by a charged particles within apertures 38. For the polarities illustrated in FIG. 2 and assuming a positively charged particle it may readily be seen that a particle which is vertically displaced from the center of an aperture 38 would experience a strong restoring force tending to move it towards the center of the aperture 18. A positive particle displaced in a horizontal direction, however, would experience a strong antirestoring force. As was discussed above, it is well known to those skilled in the accelerator art that by alternating focusing devices, such as the planar array of electrostatic quadrupoles shown, which have opposite polarities with respect to each other, a strong net focusing effect may be achieved on a particle beam. What is missing from the prior art is any realization that a single structure may be used to focus a plurality of parallel beams or beamlets and thereby achieve the objectives discussed above.

Figure 3:
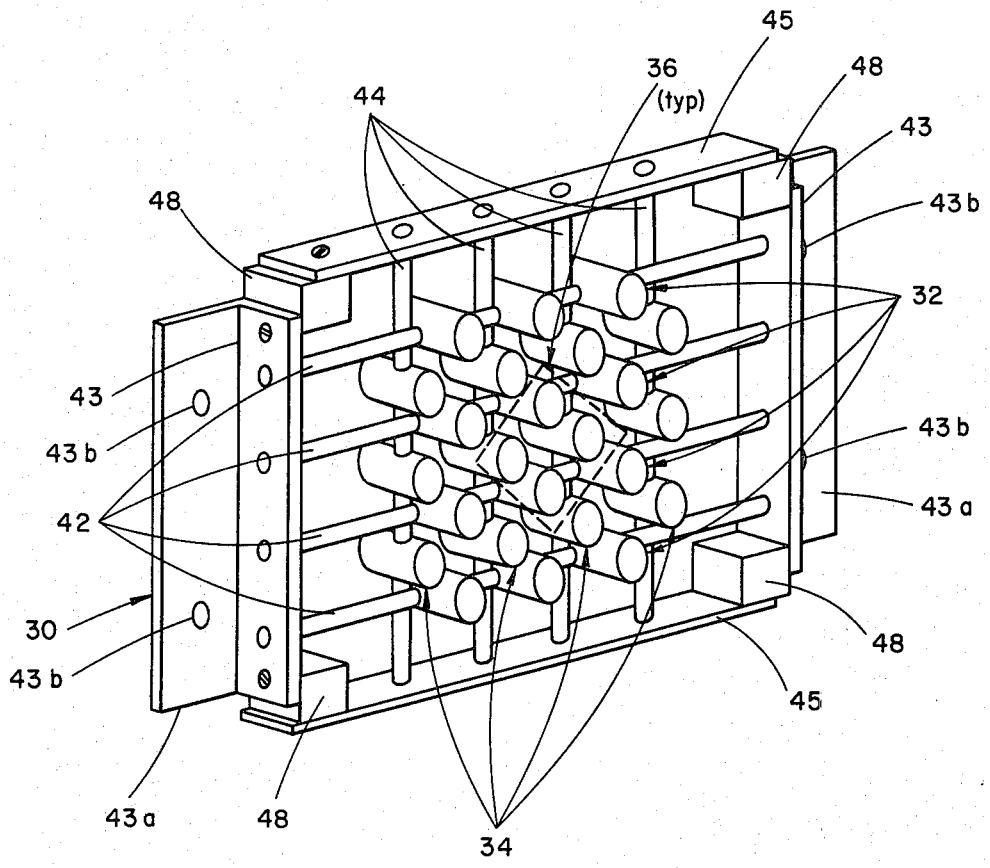
FIG. 3 is an isometric drawing of a planar array of electrostatic quadrupoles.

Referring now to FIG. 3 there is shown an embodiment of the planar array of the electrostatic quadrupoles schematically illustrated in FIG. 2. Array 30 comprises a square array of 9 electrostatic quadrupoles 36. It further comprises a first plurality of the electrodes 32 having a first DC polarity and a second plurality equal in number to the first plurality having the opposite DC polarity. Each electrode of the first plurality 32 is mounted, in groups of 3 with appropriate spacing, along horizontal rods 42. Rods 42 are formed with a conductive material and are mounted equally spaced and parallel in conducting terminal blocks 43. The second plurality of electrodes 34 is similarly mounted to vertical rods 44 which are in turn similarly mounted in conducting terminal blocks 45. Rods 42 and 44 are spaced from each other and terminals 43 and 45 are fastened by insulating blocks 48 to form a planar array of electrostatic quadrupoles. The electrodes of pluralities 32 and 34 are pinned or otherwise conductively fastened to rods 42 or 44 respectively so that their axes are parallel to the direction of the beamlets. Electrical connection to the first and second plurality of electrodes 32 and 34 is made through terminals 43 and 45.

Terminals 43 are provided with tags 43*a* having alignment holes 43*b* to allow for the proper alignment of array 30.

The construction illustrated in FIG. 3 is advantageous in that an individual connection is not required for each electrode nor is an individual mounting insulator. It is a further advantage that insulators 48 are mounted well away from paths of the beamlets where they are not subject to radiation damage or coating by stray particles.

Other structures for forming the arrays of the subject invention may prove to be advantageous. It is anticipated that improved arrays may be developed using electrodes of various shapes (e.g., planar or cylinders with elliptical cross-sections). Using such shapes it would be possible to decrease the total array area at the possible cost of less ideal fields within the array apertures.

It is also contemplated that the quadrupole array of the present invention may be formed from just two components each comprising a metal plate having a plurality of apertures and projections. On one plate a plurality of projection would be formed adjacent to the apertures and positioned as verticle electrodes. On the other plate similar projections would be positioned as horizontal electrodes. (Note: such plates may be identical but rotated with respect to each other). By mounting such plates in line, insulated from each other, with the projections intermeshed, a plurality of quadrupoles may be formed.

Figure 6:
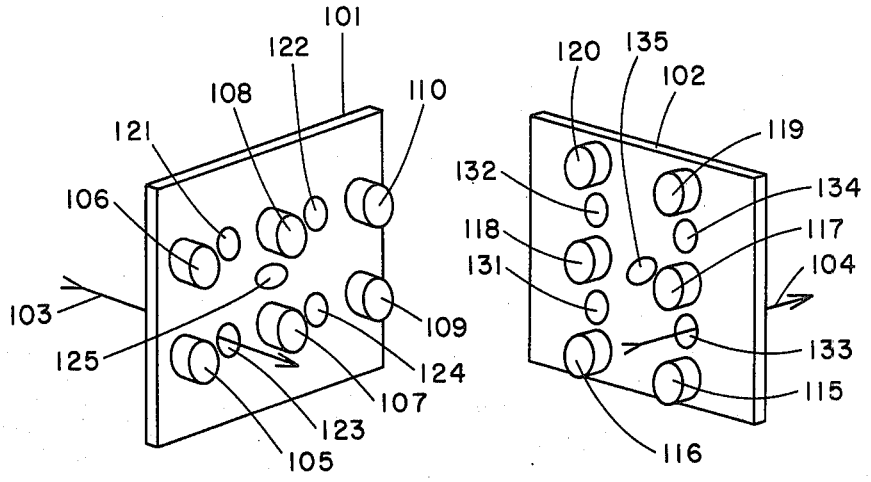
FIG. 6 is a perspective drawing of two of the components used to form a quadrupole array.

The two components required to form such a quadrupole are shown in FIG. 6. The first comprises a plate 101 containing poles 105 through 110. Between the poles are holes 121 through 125 which pass though plate 101. The second component comprises plate 102 with poles 115 through 120 and holes 131 through 135.

The poles on plate 101 are arranged in two horizontal rows of three poles each with all the poles on one side of the plate. The poles in each row are separated by a hole. Plate 102 is identical to plate 101 except that plate 102 has been oriented orthogonally with respect to plate 101 so that the poles are in vertical rows rather than in horizontal rows. The plates are also positioned so that their poles face one another.

Figure 7A:
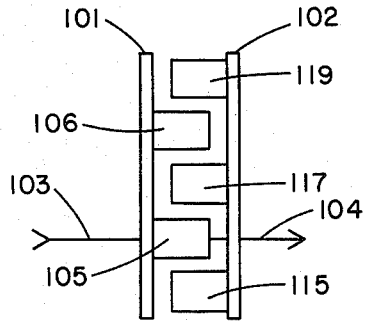
FIGS. 7A and 7B includes a side elevation view as well as an end view of the components of FIG. 6 shown with their poles intermeshed to form a quadrupole array.
Figure 7B:
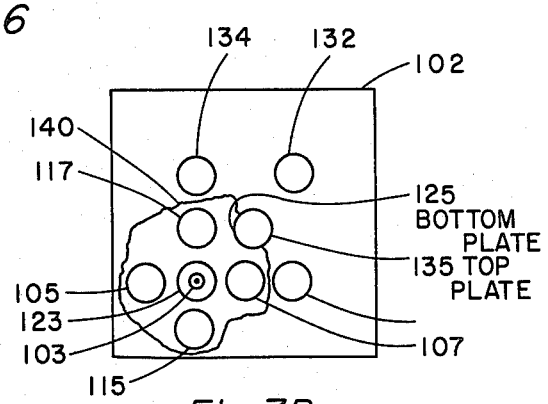

By intermeshing the poles as shown in FIG. 7A, five quadrupoles are formed. One quadrupole is formed by poles 115, 105, 117 and 107. Three of these poles can be seen in FIG. 7A and all can be seen in FIG. 7B through the broken away area 140 of plate 102. These poles are centered around hole 123 in plate 101 and around hole 133 in plate 102. Arrows 103 and 104 pass through holes 123 and 133, respectively, and represent the flow of particles in a beamlet passing through the quadrupole formed by the poles about these holes. A quadrupose with reversed polarities is formed by poles 107, 108, and 117, 118.

In a large array formed by using the type of component shown in FIG. 6, all but the exterior poles serve as a part of at least two quadrupoles. This can be seen from FIG. 7. Pole 117 serves as a pole in the quadrupole about 122 and also in the quadrupole about hole 121.

DC potential for all the quadrupoles need be supplied only to the plates. For example, if plate 101 is supplied with negative DC potential and plate 102 with positive DC potential, all the quadrupoles formed by intermeshing will be properly biased. In the quadrupole about hole 133, poles 117 and 115 are opposite one another and both will be biased positively due to their connection to plate 102, while the other pair of poles in this quadrupole 105 and 107, will be biased negatively because of their connection to plate 101.

It can be seen in FIG. 7A that the poles do not touch the opposite plate to avoid shorting the DC potential supply. The space shown between the poles and the opposite plate is exaggerated for the sake of clarity. To provide the desired focusing field, the poles are brought as close as possible, taking into account DC potential and manufacturing tolerances.

Figure 8:
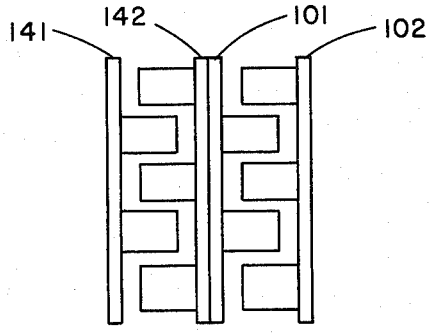
FIG. 8 is a side elevation view of a series of the same quadrupole components positioned to form cascaded quadrupole arrays.

FIG. 8 shows a cascaded array of quadrupoles formed of the same components. Plates 101 and 102 are in the same relative position as shown in FIG. 7A with their associated poles intermeshed to form an array of quadrupoles. Plates 141 and 142 are identical to plates 101 and 102 and are in the same relative position with their associated poles intermeshed to form a second array of quadrupoles. In addition, plate 142 is placed back to back with plate 101 so that the holes in plate 142 are aligned with those in 101. In this way four beams may pass through these holes, where they will be subject to the focusing fields provided the two cascaded quadrupoles.

The DC potential supplied to plate 101 is also supplied to plate 142 by virtue of their contact. The poles on plate 101 form the horizontal pairs of the quadrupole between plates 101 and 102, while those on plate 142 form the vertical pairs between plates 141 and 142. As a result, the desired alternating of DC potential polarity from vertical to horizontal poles in successive quadrupoles is automatically achieved. The number of arrays configured in this manner may be increased as desired.

Structures such as that in FIG. 8 may be used as beam transport systems to transport beams of charged particles without acceleration. (The operation of a low energy beam transport system using the quadrupole arrays of FIG. 3 will be described below.) Such structures may be produced inexpensively in large numbers in order to form extensive beam transport systems. It should also be noted that the structure of FIG. 8 need not comprise two separate plates 101, 142, but may be formed as a single piece.

Such components could be inexpensively machined or cast. This is expected to be particularly advantageous, since it is anticipated that the advantages of the present invention may best be achieved by arrays having large numbers of relatively small quadrupoles. Further, the number of quadrupoles per unit area is approximately doubled since the quadrupoles of opposite polarity, which are blocked by rods 42 and 44 in the design shown in FIG. 3, are available.

Figure 4:
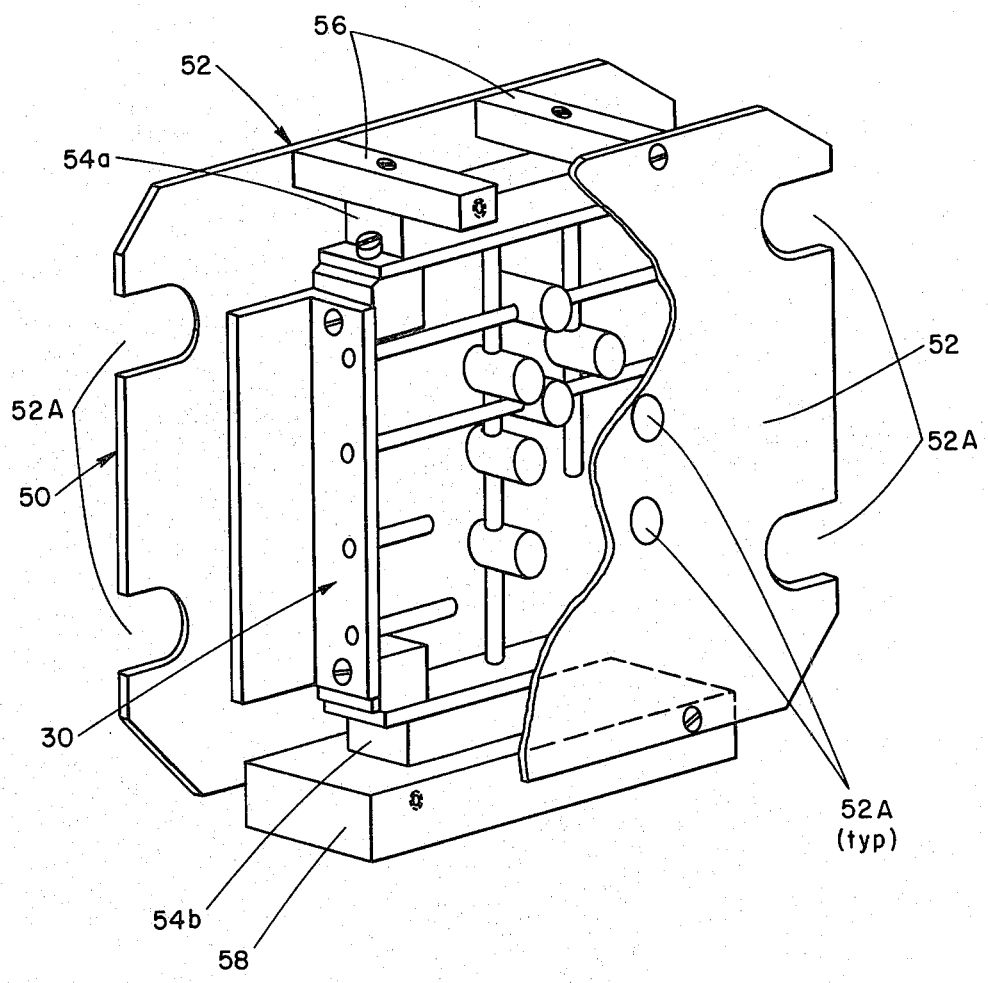
FIG. 4 is an isometric drawing, partially broken away, of a drift tube assembly.

Turning now to FIG. 4, there is shown a drift tube 50 according to the present invention.

Drift tube 50 comprises an array 30 mounted between conducting plates 52 by connection to insulators 54*a* and 54*b* fastened to spacers 56 and block 58 which function to hold plates 52 parallel and aligned and are sized so that spacing between plates 52 is appropriate. Block 58 also functions to electrically connect plates 52 to RF ground. Where drift tube 50 is connected to the RF buss (described below) block 58 is replaced by a second pair of spacer 56.

Plates 52 have a plurality of holes 52*a* which are aligned with and equal in number to apertures 38 of array 30, and which allow passage of the beamlets. Plates 52 also have notches 52*b* to allow passage of alignment rods which will be further described below.

Figure 5:
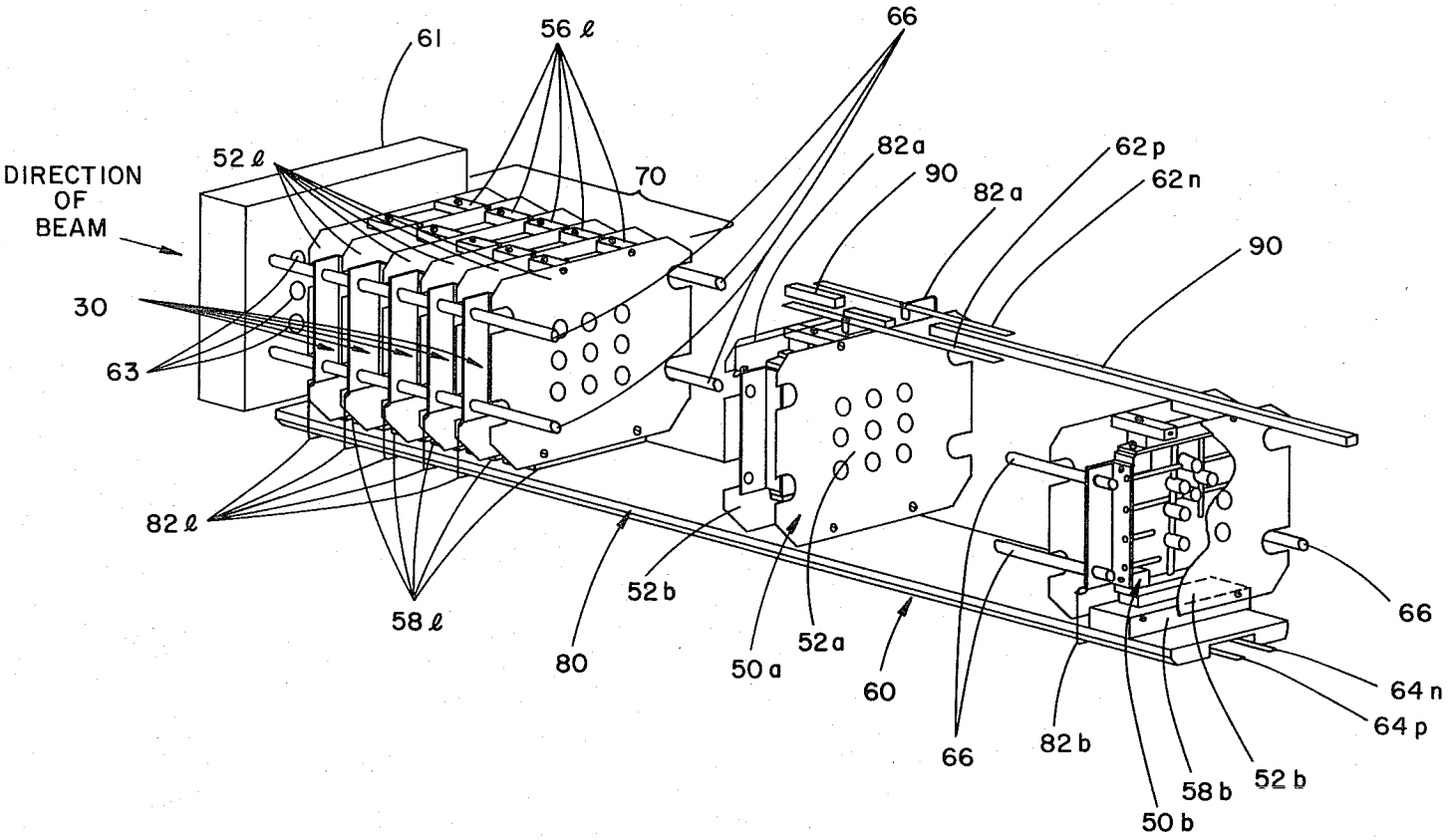
FIG. 5 is an isometric drawing, partially broken away, of a Linac assembly according to the present invention.

Turning now to FIG. 5 there is shown a Linac assembly 60 utilizing arrays 30 and drift tubes 50 of the subject invention which is suitable to accelerating singly charged xenon ions to an energy of approximately 56 keV above the injection energy. Array 60 is intended for use with conventional vacuum vessels and ion sources which are not shown for ease of illustration.

Starting from the injection end of assembly 60 the continuous beam from the ion source (not shown) is first prebunched by buncher 61. This prebunching improves the amount of beam captured.

In the embodiment shown in FIG. 5 buncher 61 consists of a metal plate approximately one-half a particle wavelength thick and having a plurality of holes slightly larger than, and aligned with, holes 52*a*. (By "particle wavelength" herein is meant the distance through which a particle moves in one RF cycle). Buncher 61 is mounted on glass rods 66 and connected to a source of RF power. The magnitude of RF voltage necessary to obtain optimum bunching may be calculated from known principles by a person skilled in the linear accelerator art. The phase of the RF is then adjusted for maximum current.

The beam then enters low energy beam transport section (LEBT) 70. This LEBT 70 serves to isolate the ion source from the following RF sections which will be described below. LEBT 70 comprises five electrostatic quadrupoles arrays 30*l* which are separated by six plates 52*l*. Plates 52*l* are essentially identical to plates 52 used in the drift tubes 50 shown in FIG. 3. The five electrostatic quadrupoles 30*d* are mounted on and aligned by glass alignment rods 66. The plates 52*l* are mounted to quadrupoles 30*l* by insulating mountings 56*l* and by ground conductive blocks 58*l*. The conductive blocks 58*l* connect plates 52*l* to mounting frame 80 which also serves as an RF ground. Thus LEBT 70 comprises five equally spaced and aligned quadrupoles 30*l* which are separated by plates 52*l* so as to form a five section LEBT 70. Connections 82*l* to a first pair of DC busses (not shown) provide appropriate DC voltages to quadrupoles 30*l*. (Only connections to the horizontally mounted electrodes are shown for ease of illustration).

It has been found advantageous to operate LEBT 70 quadrupoles 30*l* at lower voltages than drift tube 50 quadrupoles 30 to allow for emittance mismatch between the ion source and the accelerating section and since a somewhat higher voltage is needed on quadrupoles 30 to compensate for a slight defocusing effect caused by the RF accelerating voltage.

LEBT 70 thus provides an initial focusing of the beam without any acceleration and isolates the following RF powered drift tubes from the ion source.

Advantageously the quadrupoles for LEBT 70 may be formed from a plurality of identical components comprising metal plates having a plurality of apertures and projections. On one side of each plate a plurality of projections would be formed adjacent to the apertures positioned as the vertical electrodes of a quadrupole. On the other side of the plate a similar plurality of projections would be formed but would be positioned as horizontal electrodes. By mounting an array of such components in line, insulated from each other, so that the projections intermeshed a plurality of quadrupoles would be formed between each pair of plates. By connecting alternate plates to DC potentials of opposite polarity the array would comprise an LEBT.

LEBT 70 is followed by a first drift tube section 50*a*. Plates 52*a* of drift tube section 50*a* are connected (connections not shown) to RF buss 90. DC voltages (positive and negative) are supplied through connections 82*a* to the quadrupole of drift tube 50*a* by a second pair of DC busses 62*p* and 62*n*. DC busses 62*p* and 62*n* are used to provide DC to all RF powered drift tube sections. Drift tube 50*a* is mounted on and aligned by glass rods 66. Drift tube 50*a* is followed by a grounded drift tube 50*b*. (The spacing between drift tubes 50*a* and 50*b* is shown greatly exaggerated for ease of illustration). Drift tube 50*b* is similar in all respects to drift tube 50*a* except that plates 52*b* are grounded to frame 80 by conducting mounting block 58*b*. DC voltages (positive and negative) for the quadrupole of drift tube 50*b* are provided through connections 82*b* by a third set of DC busses 64*p* and 64*n*. The quadrupole of drift tube 50*b* is again mounted on and aligned by glass rods 66.

The spacing between drift tubes 50*a* and 50*b*, and all other drift tubes, is determined by the mass and charged state of the ion to be accelerated and by the frequency and voltage of the RF power supply (not shown) according to principles that are well known by those skilled in the art of linear accelerator design. It has been determined that the theoretical optimum potential for the electrostatic quadrupoles 30*a* and 30*b* in a wide range of linac designs is approximately 0.115 times the injection energy (in electron-volts) of the particles. Empirically this potential is usually slightly higher in order to correct for the RF defocusing effect. Additional RF powered and grounded drift tubes (not shown) are provided to supply additional acceleration until the desired acceleration is reached.

The separate busses 62*p* and 62*n* for the RF powered drift tubes pass through the resonator coil of the RF power supply so that the potential on the electrodes is either + or − the DC potential with respect to plates 52*a*.

DESIGN GUIDES

The following relations are useful in designing embodiments of the subject invention in various applications. In the following:

k is defined as the ratio of space charge forces to restoring (focusing) forces. Experience and computer simulation indicate $k \simeq 0.5$ $k_3$ is the quadrupole radius ($r_o$) divided by the initial particle wave length ($\beta_o\lambda$). A resonable value 0.125.

$k_4$ is the quadrupole length divided by the number of particle wave length per focusing cell ($n\beta\lambda$). A reasonable value is 0.4.

$\mu_o$ is the phase advance per cell with zero space charge force. A reasonable value is 1.5.

$\eta$ is the ratio of the average radius of the beam envelope to the maximum radius ($r_{ave}/r_{max}$). A reasonable value is 0.707.

n is the number of half particle wave lengths measured from the center of one accelerating gap to the center of the next. In the apparatus above n=1. (It should be noted that other configuration having other values of n are well known in the accelerator art).

A focusing cell is defined as two drift tubes each containing a quadrupole. The cell length ($L_c$)=the length of the two drift tubes plus two gap lengths.

Using the above definitions, and the above values where numerical values are given, the following relations hold: where:

$E_{Qm}$≡the pole tip field of the quadrupoles $\epsilon_{NT}$≡the transverse acceptance of the machine $P_{6d}$≡the six dimensional phase space density A≡the ratio of the particle mass to the proton mass $\beta$≡ratio of the particle velocity to the velocity of light $\beta_o$≡the initial $\beta$ f≡the RF frequency z≡the particle charge state The conditions for maximum $P_{6d}$ are:

$$\overline{E} \simeq 0.2 E_{Qm} \text{ and}$$

$$\epsilon_{NT} \simeq \epsilon_{NL}$$

where:

$\overline{E}$≡average accelerating field $\epsilon_{NL}$≡the longitudinal acceptance of the machine For $\epsilon_{NT}=\epsilon_{NL}$ it is sufficient that:

$$\frac{fr_o}{\beta c} = k_3 \text{ and}$$

$$E \cos \phi_s = \frac{0.5\, \mu o^2 \eta^{4/3}}{n^2} \; \frac{fA\beta}{z}$$

where:

c≡velocity of light $\phi_s$≡the stable phase angle (i.e., the phase of the RF at which the particles must enter the machine to maintain a constant phase at each accelerating gap.)

$r_o$≡the quadrupole radius

If we introduce a parameter V such that:

zeV=the particle injection energy (i.e., V is the ion source extraction voltage);

where:

e≡the electron charge then the following relations also hold:

$$i_{max} \simeq 1.7 \times 10^{-8} \frac{V^{3/2} Z^{\frac{1}{2}}}{A^{\frac{1}{2}}}$$

$$\epsilon_{NT} \simeq 1 \times 10^{-6} \frac{V^{3/2} Z^{\frac{1}{2}}}{E_{Qm} A^{\frac{1}{2}}}$$

$$r_o \simeq 0.23\ V/E_{Qm}$$

$$V_Q = E_{Qm}\, r_o/2 \simeq 0.115V$$

$$r_{max} \simeq 7.5 \times 10^3 \frac{E_{Qm} Z^{\frac{1}{2}}}{V^{\frac{1}{2}} A^{\frac{1}{2}}}$$

While the Linac of the subject invention will operate with a wide variety of ion sources, preferably a modern multiple apperture source will be used so that each apperture may provide a beamlet. For optimum performance the following relations should be satisfied:

$$TeV \leqq 0.18V$$

$$d \geqq 4.8 \times 10^8_z \frac{E_Q{}^3{}_m}{\frac{1}{2}V} \text{ (meter)}^{-3}$$

where:

Tev≡the characteristic temperature of the source in electron volts.

d≡the plasma density in the source.

(Note units are MKS with E in volts/meter).

a. Experimental Example

A small experimental Linac (the M1 MEQALAC) has been constructed in accordance with the subject invention.

| | |
|---|---|
| Ion Accelerated | $Xe^{+1}$ |
| No. of Beams | 9 |
| Machine Type | Wideroe |
| Injection Energy | 15.5–17.3 keV |
| Output Energy | 71.5–73.3 KeV |
| Input $\beta\gamma/2$ | 1.89 cm |
| Output $\beta\gamma/2$ | 3.95 cm |
| RF Frequency | 4 MHz |
| Peak RF Voltage | 5 kV |
| Accelerating Voltage | 3.5 |
| Stable Phase Angle | $\sim\sin^{-1}$ 3.5/5.0 45α |
| Nominal Quad Voltages | ±2 kV |
| Repetition Rate | 10 pps (arc supply ltd) |
| Pulse Length | 500 usec (arc supply ltd) |
| Pre-Buncher | $\beta\gamma/2$, 4MHz, 1–1.5 kV |
| Nominal Vacuum | $10^{-5}$ torr |
| Gas Feed | Continuous |
| Calculated Avg. Current During Pulse-S.C.L. | 3.3 mA |
| Measured Current | 2.8 mA |

The acceleration assembly (similar to that shown in FIG. 5) is suspended in six inch Varian vacuum pipes. The ion source, operating at +15.5−17.3 kV DC, is shielded by a screen enclosure and isolated from the metal pipe by a 6 inch diameter×6 inch long Pyrex vacuum pipe. The vacuum pump is a Welsh Turbo-Torr 1500 l/sec unit and is mounted below a "cross" vacuum section. The upper port of the "cross" is used for quadrupole high voltage feedthrough. The forepump sits behind a panel with the circular ventilation screen.

The RF voltage is fed through the bottom of a "tee" section. The 4 MHz transmitter and tank circuit resonator are mounted separately. A Faraday cup is held on a rod inserted through a vacuum fitting on a Lucite end cover, and Dc potential grid voltage and beam pickup connections are fed through the same cover.

A separate rack enclosure is provided for the ion source power supplied, controls, and cooling system.

The accelerator has a pre-buncher "tube" or plate. The buncher tank circuit resonator is mounted beneath the ion source screen enclosure. The pre-buncher RF is fed to the buncher tube through a Covar seal in the Pyrex pipe which isolates the ion source.

b. The Quadrupole—Drift Tube Configuration

FIG. 4 shows the quadrupole array. The poles are made of 5/16 inch diameter aluminum, and arranged for nine beams with 5/16 bore diameter. It was estimated that a 1% (~0.003 inch) tolerance was needed on the position of any pole tip. To accomplish this, the arrays were made on precision fixtures. ⅛ inch precision-ground steel rods are pinned to the frame and pole tips in the fixtures, thus avoiding thermal expansion problems had they been soldered. The insulators at the corners were made of Rexolite.

M1 had 8 drift tubes operating at RF potential, 7 drift tubes at ground potential, and 5 LEBT (Low Energy Beam Transport) quadrupole arrays, making 20 quad arrays in all. The LEBT and ground drift tubes are screwed to a steel alignment plate. This plate is hung from the top of the vacuum pipe. The RF drift tubes are suspended from ¼" Rexolite rods which run through the side plates attached to the quad arrays as seen in FIG. 3.

RF connections are made to a copper bus bar which runs at the bottom of the vacuum pipe. Near the RF bus are two busses for the ±DC quad voltages for the RF quads. The feed lines for these are run through the resontor coil. There are two busses above the accelerating assembly for the ± quad voltages for ground drift tubes. The complete assembly is shown in FIG. 5.

The LEBT quads have separate busses and are run from a separate power supply. In operation, they run at a lower potential for two reasons: (1) The LEBT quads must compensate for any emittance mismatch between the ion source and the accelerating sections and (2) a small RF defocusing effect in the accelerating section is expected.

The accelerating section has 16 accelerating gaps. The drift tube table (Table II) is calculated for 3.5 keV energy gain at each gap. The quadrupole lengths are proportional to the velocity of the particle. It follows that the same phase advance/cell is maintained by having the same voltage on all of the accelerator quadrupoles. Thus, the M1 has a power supply which provides ± quad voltage for the accelerating section (with extra output connectors to feed the RF quads), and another which supplies ± voltage for the LEBT quadrupoles.

TABLE II.

DRIFT TUBE TABLE

| | Drift Tube NO | Energy EV | Transit Time Factor | Particle Velocity M/S | Drift Tube Length CM | Drift Tube Length IN | Electrode Length CM | Electrode Length IN |
|---|---|---|---|---|---|---|---|---|
| G | 0 | 15500. | | 151262. | — | — | — | — |
| RF | 1 | 19000. | 0.913 | 166126. | 1.702 | 0.670 | 0.990 | 0.390 |
| G | 2 | 22500. | 0.926 | 181192. | 1.890 | 0.744 | 1.080 | 0.425 |
| RF | 3 | 26000. | 0.935 | 195054. | 2.063 | 0.812 | 1.163 | 0.458 |
| G | 3 | 29500. | 0.943 | 207968. | 2.225 | 0.876 | 1.240 | 0.488 |
| RF | 5 | 33000. | 0.949 | 220108. | 2.376 | 0.936 | 1.312 | 0.517 |
| G | 6 | 36500. | 0.953 | 231600. | 2.520 | 0.992 | 1.381 | 0.544 |
| RF | 7 | 40000. | 0.957 | 242539. | 2.657 | 1.046 | 1.446 | 0.569 |
| G | 8 | 43500. | 0.961 | 253000. | 2.788 | 1.097 | 1.508 | 0.594 |
| RF | 9 | 47000. | 0.964 | 263040. | 2.913 | 1.147 | 1.568 | 0.617 |
| G | 10 | 50500. | 0.966 | 272708. | 3.034 | 1.194 | 1.626 | 0.640 |
| RF | 11 | 54000. | 0.968 | 282041. | 3.151 | 1.240 | 1.681 | 0.662 |
| G | 12 | 57500. | 0.970 | 291073. | 3.263 | 1.285 | 1.735 | 0.683 |
| RF | 13 | 61000. | 0.972 | 299831. | 3.373 | 1.328 | 1.787 | 0.704 |
| G | 14 | 64500. | 0.973 | 308339. | 3.479 | 1.370 | 1.838 | 0.724 |
| RF | 15 | 68000. | 0.975 | 316617. | 3.583 | 1.411 | 1.888 | 0.743 |
| G | | 71500. | | 324683. | | | | |

TABLE II.-continued

DRIFT TUBE TABLE

| Drift Tube NO | Energy EV | Transit Time Factor | Particle Velocity M/S | Drift Tube Length CM | Drift Tube Length IN | Electrode Length CM | Electrode Length IN |
|---|---|---|---|---|---|---|---|
| Linac Length = 41.017 + 16 × 0.375 = 47.017 cm | | | | | | | |

c. Ion Source, Match to LEBT, and Pre-buncher

While the Linac of the subject invention may be used with a large variety of conventional ion sources good experimental results were obtained with a version of the ion sources developed by Lawrence Berkeley Laboratory for the Controlled Threnonuclear Reactor Program. This type of source, with multiple distributed filaments in a chamber, produces a very quiet and uniform plasma. The electron efficiency is low, but when operated with xenon the filaments are long-lived even with cw filament operation for the modest current densities needed.

Typical operating parameters are:

TABLE III.

| ION SOURCE PARAMETERS | |
|---|---|
| Fil voltage | 7.5 Vac |
| Fil current | 150 amps ac |
| Arc current | 25A |
| Arc voltage | 50V |
| Ion current density | 25 m/Acm$^2$ |

In operation, the filaments and gas run cw, and the arc voltage is pulsed. The current density is adjusted from 1–50 mA/cm$^2$ varying the filament power.

Previous emittance measurements with this source yielded 25 mA of $Xe^{+1}$ into 10 cm-mrad at 15.5 keV. Although these measurements were performed under space-charge neutral conditions after the extraction gap, it is clear that a considerable degree of emittance "spoiling" is necessary to fill the transport channel.

We have found one special solution to this highly non-linear problem experimentally. The slits are cut in concave "dimples" of 1¼ inch radius in both the arc cover plate and grounded extraction plate. The area of the extraction hole is 0.35 cm$^2$, with an aspect ratio of 3:1. This gives us a converging beam in the dimension parallel to the slit, and a diverging beam in the direction perpendicular to the slit. We adjusted the quad channel position for maximum transported current, and obtained 2.4–2.6 mA of $Xe^+$ when the first quad end was ⅞ inch from the extractor plate. For the highest current levels, it was found that the arc voltage should be raised to 70–80 volts.

In this case, the total current emerging from the extractor is ~8 mA, and we transport ~2.5 mA. We assume that the acceptance of the channel is well filled, but this has not been measured to date.

With a ⅞" gap between the extractor plate and the first LEBT quad, we are able to insert a pre-buncher plate of ½ inch thick aluminum. This has nine ½ inch diameter holes and is suspended on the same Rexolite rods. The $\beta\lambda/2$ length between the centers of the buncher gaps is 0.75 inch.

The drift length from the buncher to the first RF gap is 4 inches (through five LEBT quad arrays). This drift length is sufficient to give a 45α phase shift with 1.5 kV buncher voltage.

The instantaneous bunch current has the same transverse spacecharge limit as the DC transport limit. Therefore, we have competing "bottlenecks" in the transport at each end of the LEBT. This was verified in operation of M1, by observing that the ion source could be run from 10–25 mA/cm$^2$ current density without changing the output current.

d. RF System

The RF system consists of two major parts; an amplifier and a resonator.

The amplifier is a 4 MHZ, 2 stage, 700 watt linear amplifier with broadband interstage coupling. The input RF amplitude range is 0 to 1 volt peak, for an output power level from 0 to maximum. The amplifier is single-ended throughout the two output tubes driven in parallel. The input stage is operated in a class A mode with control grid modulation to compensate for beam loading. The interstage coupling is performed by a Tchebycheff filter so that tuning is unnecessary. The final stage tubes operate in a class $AB_1$ mode. This stage operates in a stable fashion with grid and screen parasitic suppressors but no neutralization. The RF plate connection is directed vertically and passes through a small duct into the resonator compartment normally mounted above.

The resonator is a three turn coil of ¾ inch copper tubing with a nine inch mean diameter. The amplifier plate connection is made at the first turn to give a step-up turns ratio of 1:3, thus providing 3 kV peak RF at the accelerating gaps. The unloaded Q of the resonator with the accelerating structure connected was measured at 680. The noload or tank and accelerating structure losses amount to 300 watts. The remainder of the output power is beam loading. The 3rd turn, or top of the coil has a flange to mate with a flanged bus from the accelerating structure just below a vacuum window. Two RG 58 coaxial cables for ±DC voltage for the RF quads can be seen entering the bottom coil mounting flange. They leave through the top mounting flange and thus have RF isolation. From the top of the resonator to ground is a 300 pF vacuum capacitor for final stage tuning. Below the tuning capacitor is a 1:1000 capacitive divider for monitoring the gap voltage.

The RF is switched at the oscillator and modulated at the first stage of the Rf amplifier from timing pulses generated at the master timing panel.

The buncher is divided by a helical resonator and, in turn, driven by a commercially built wideband amplifier. The 4 MHz oscillator also provides the low level RF signal that drives the buncher amplifier. A separate RF amplitude control is provided, and a phase shifter is included so that the relative RF phase between the accelerating gaps and buncher may be tuned.

IV. M1 OPERATING RESULTS

After running the M1 for several days, all systems were working together to produce good results under the conditions of Table IV.

TABLE IV.

| OPERATING CONDITIONS | |
|---|---|
| Source | MEQALAC |
| Fil Current: 133A | LEBT Quads: ±1.8 kV |
| Arc Current: 29A | Linac Quads: ±2.25 kV |
| Source Voltage: +17.3 kV | RF Voltage: 4.7 kV |
| | Buncher Voltage: 1.5 kV |
| Vacuum: | $2 \times 10^{-5}$ torr |

The output current of all nine beams was collected in a single Faraday cup with a −300 V biased grid. The signal was terminated in 1 kΩ with an integrating capacitor. The average current is 2.8 mA. There is about a 10% RF signal passing the integrator.

The instantaneous peak current per beamlet is 2.8 mA. We obtain an experimental RF filling factor from these two results of 11±1%. This is obtained by solving the relationship (2.8 mA/beam)×(9 beams)×(fill factor)=2.8 mA Total Avg. Current.

The error quoted is an estimate of several factors including different peak currents obtained for individual beamlets, which was probably due to the coarseness of the grid Dc potential wires compared to the small beam sizes.

The operation of the quadrupoles was straightforward and troublefree. We measured 0.2 mA of current drain from the quad supplies during beam time.

At $V_{input}$=17.3 kV, $V_Q$ is ±2.0 kV. Our best results were obtained with $V_Q$=±2.25 kV. The theoretical estimate does not take into account the effect of RF defocusing.

An important consequence of the above quad voltage relationship is that the focusing channel can be arbitrarily close to the ion source extraction gap. That is to say, if the ion source operates without sparking at the extractor, then the channel shouldn't spark either. This is very favorable for further MEQALAC development since improvement calls for smaller beams and higher ion source current densities.

The above detailed description, specific examples, and drawings are provided by way of illustration only and limitations on the scope of this invention are to be found only in the claims set forth below. In particular, it should be noted that other types of Linac, which also comprise drift tubes containing focusing devices and utilize RF accelerating voltages, are well known in the art and a person skilled in the art could readily make and use different embodiments of the Linac of this invention by incorporating the focusing apparatus of this invention in such types of Linacs.

What is claimed is:

1. Apparatus for electrostatically focusing a beam of charged particles, comprising:

(a) a first support plate, the first plate including a first plurality of holes, and (b) a first plurality of pairs of substantially identical projections to serve as electrostatic poles for focusing the beam located on one side of the first plate the poles of each of the pairs are on diametrically opposite sides of a corresponding one of the holes and spaced equidistant from the center of the hole, so that each hole corresponds with a single pair of poles.

2. Apparatus as claimed in claim 1, wherein the poles are cylindrical and the axis of revolution of the poles is orthogonal to the surface of the plate.

3. Apparatus as claimed in claim 1, further comprising:

(a) a second support plate, the second plate including a second plurality of holes, and (b) a second plurality of pairs of projections substantially identical to those on the first plate to serve as electrostatic poles for focusing the beam, the pole being located on one side of the second plate, and the poles of each of the pairs being on diametrically opposite sides of a corresponding one of the holes and spaced equidistant from the center of the hole, the distance from the center being the same as the distance of the first poles from the centers of the first holes, so that each hole corresponds with a single pair of poles.

4. Apparatus as claimed in claim 3, wherein the first and second plates are positioned parallel to one another with corresponding holes on each plate centered on an axis orthogonal to the plates, the corresponding poles of each pair of holes centered on a particular axis facing each other and intermeshed without making contact, and the lines connecting the centers of each of the first plurality of pole pairs, which pass through the centers of the first holes, being substantially orthogonal to the corresponding lines of the second poles.

5. Apparatus as claimed in claim 4, wherein the plates and poles are conductive and DC potential of one polarity is connected to the first plate to supply the poles on the first plate, while DC potential of the opposite polarity is applied to the second plate to supply the opposite DC potential to the poles of the second plate to form a quadrupole array for electrostatically focusing a plurality of beams passing through the centers of the first and second holes.

6. Apparatus as claimed in claim 5, wherein the first and second plate are identical with the poles aligned in straight parallel rows with holes located between pairs of poles in the rows and the rows on the first plate are aligned orthogonal to those in the second.

7. Apparatus as claimed in claim 6, wherein a pole serves in at least two quadrupoles.

8. Apparatus as claimed in claim 6, wherein a second array identical to the first, is connected back to back with the first, to cascade the arrays, the centers of the holes in the first array being aligned with those in the second on axes orthogonal to the plates to pass a plurality of parallel beams through the holes, the rows on the contacting plates which are back to back are orthogonal and the same DC potential is applied to the back to back plates to alternate the DC potential on similarly aligned poles in successive quadrupoles.

9. A method for electrostatically focusing a plurality of parallel beams comprising the steps of:

(a) supplying a first conducting support plate having a plurality of conducting projections to serve as electrostatic focusing poles, the poles being located on one side of the plate, and being positioned in parallel rows spaced uniformly apart, the poles in the rows having the same spacing between poles as between rows, the plate having a hole centrally located between each pole in each row, (b) supplying a second plate identical to the first, (c) locating the plates parallel to one and other, (d) orienting the rows on the first plate orthogonal with respect to those on the second, (e) aligning the centers of each pair of corresponding holes on opposite plates on an axis lying perpendicular to the plates, (f) intermeshing the poles without making contact between the poles and the opposite plate and maintaining each of the hole pairs on the axis, and (g) applying DC potential to the poles by way of supplying opposite polarity to the first and second plate to produce a focusing field on beams passing through the hole pairs.

10. Apparatus as claimed in claim 8, wherein the contacting, back to back plates, are formed as a single piece.

* * * * *